US005960988A

United States Patent [19]

Freixas

[11] Patent Number: 5,960,988

[45] Date of Patent: Oct. 5, 1999

[54] AUTOMATIC DRINKING STRAW DISPENSING DEVICE

[76] Inventor: Oscar Freixas, 2435 SW. 23rd St., Miami, Fla. 33145

[21] Appl. No.: 09/020,521

[22] Filed: Feb. 9, 1998

Related U.S. Application Data

[63] Continuation-in-part of application No. 08/612,428, Mar. 7, 1996, Pat. No. 5,743,430.

[51] Int. Cl.[6] ..... G07F 11/00

[52] U.S. Cl. ..... 221/13; 221/195

[58] Field of Search ..... 221/9, 13, 14, 221/253, 191, 266, 194, 195

[56] References Cited

U.S. PATENT DOCUMENTS 3,019,575 2/1962 Charley et al. ..... 53/505

3,519,166 7/1970 Yingst et al. ..... 221/13

*Primary Examiner*—Kenneth W. Noland

[57] ABSTRACT

An automatic drinking straw dispensing device having a primary receptacle that contains a plurality of drinking straws therein, a generally elongate slot formed in the primary receptacle and structured to permit the passage of the drinking straws therethrough, a single straw dispensing assembly structured to selectively permit only one of the drinking straws to exit the primary receptacle through the elongate slot at one time and only after a beverage has been dispensed by a beverage dispensing device, a dispensing area disposed beneath said generally elongate slot so as to receive the dispensed drinking straw exiting said primary receptacle, and a switch assembly which is actuated by a user's hand entering the dispensing area so as to trigger the single straw dispensing assembly into dispensing one of the drinking straws through the elongate slot and directly into the user's hand.

21 Claims, 2 Drawing Sheets

AUTOMATIC DRINKING STRAW DISPENSING DEVICE

The present application is a continuation-in-part application of previously filed, now pending application having U.S. Ser. No. 08/612,428 filed on Mar. 7, 1996 now U.S. Pat. No. 5,743,430.

BACKGROUND OF THE INVENTION

1. Field of the Invention

The present invention relates to an automatic drinking straw dispensing device which can effectively and sanitarily dispense a drinking straw, stirrer, rolled napkin assembly, or smoker's article automatically and efficiently, and without taking up substantial amounts of space, such that upon the purchase of a beverage or other article from a vending machine at a remote location a consumer has such products easily available for use.

2. Description of the Related Art

Drinking straws are frequently utilized to assist with beverage consumption, and in particular many individuals prefer the use of drinking straws when drinking from a container such as a bottle or can. Specifically, because bottles, and cans especially, are frequently distributed by a dispensing machine, and a user must generally place their mouth on an exterior, exposed portion thereof during drinking, many persons prefer to utilize straws for sanitary purposes. Furthermore, a can or bottle can sometimes include a sharp surface which may injure an individual, or may be uncomfortable to drink as a person's mouth generally covers the entire opening and makes it difficult to sip the liquid due to the lack of an air inlet. As a result, most commercial establishments make straws available to their consumers in order to satisfy their sanitary preferences. For example, it is a frequent occurrence that a large dispensing assembly be placed on a counter such that an individual, merely by depressing a lever or turning a knob my effectively dispense a clean drinking straw for their consumption needs.

One commercial location at which drinking straws are not make readily available, however, relates to automatic dispensing machines. Because such machines do not require an attendant be present, and are generally positioned outside or in a confined area, drinking straws are generally not made available, partly for fear that another will tamper with the drinking straws or will take excessive quantities of the drinking straws such that they will not be available for subsequent consumers, and partly because of the limited or non-existing counter space available at the site of the machine. Accordingly, individuals receiving a beverage from an automatic dispenser are generally left to find their own straws or a napkin so as to wipe down the surface of the can around the opening.

Generally, most conventional drinking straw dispensing devices are manually actuated bins wherein an individual may pull/push on a lever or turn a knob in order to dispense a straw for their use. A consumer is able to take as many straws as they desire whenever they desire, and generally the bins are located on a counter top or other location such that an employee can ensure that the dispenser is not tampered with or unnecessarily emptied. Unfortunately, however, there is a substantial need in the art for a compact and conveniently useable dispensing assembly which can be implemented with an automatic beverage dispensing machine. Such a device should be able to fit conveniently within existing beverage dispensing machines without taking up substantial space, and be safe and efficient, ensuring that it cannot be un-necessarily emptied.

In the past, another had attempted to develop automated dispensing machines to dispense a drinking straw. In particular, the reference to Yingst et al. (U.S. Pat. No. 3,519,166) discloses a drinking straw dispenser to be utilized with a vending machine. However, such a device dispenses the straws endwise, thereby requiring a substantial amount of space within the vending machine housing be allocated for the straw dispensing assembly, as it is structured to pivot the straw outwardly for dispensing. Furthermore, such a device can easily become backed up if a user does not actually remove the straw dispensed to them. Specifically, as a subsequent straw is dispensed, if the previously dispensed straw was not retrieved the new straw will merely push the previously dispensed straw out onto the ground. Moreover, the opening from which the dispensed straw is pulled is not configured so as to prevent tampering with a straw contained therein such that a mischievous individual may tamper with a straw, but not remove it, and it will be dispensed subsequently to a further unsuspecting consumer.

Accordingly, there is a substantial need in the art for an automatic drinking straw dispensing device which can take up minimal space within an automatic dispensing machine, and which conveniently positions the straw for retrieval by consumer only when actually desired by a consumer. Furthermore, such a device should be simple and inexpensive, and provide minimal risk of tampering with the straw, backing up of un-retrieved straws or retrieval of excess amounts of straws. The device of the present invention is such a product.

SUMMARY OF THE INVENTION

The present invention relates to an automatic drinking straw dispensing device preferably structured to be mounted within an inside cover of a conventional beverage dispensing machine. Specifically, the automatic drinking straw dispensing device includes a primary receptacle. The primary receptacle is structured and disposed to contain a plurality of straws to be dispensed therein. Furthermore, the primary receptacle includes a generally elongate slot. The elongate slot is positioned within the primary receptacle so as to permit the passage of drinking straws conveniently and effectively therethrough in a generally longitudinal, rolling manner.

Cooperatively disposed with the elongate slot of the primary receptacle is a dispensing area. The dispensing area is disposed so that the drinking straws which pass through the elongate slot are directed therein for convenient retrieval by consumer. Furthermore, in order to ensure that only one drinking straw exits the primary receptacle to the dispensing area through the elongate slot at one time, a single straw dispensing assembly is included.

Further disposed relative to the dispensing area so as to be actuated by a user's hand entering the dispensing area is a switch assembly. The switch assembly is structured to trigger the dispensing of a single drinking straw by the single straw dispensing assembly. Accordingly, upon actuation by a user, and preferably only upon the purchase of a beverage, the single straw dispensing assembly permits only one drinking straw to pass through the elongate slot and preferably directly into the user's hand disposed in the dispensing area.

It is an object of the present invention to provide an automatic drinking straw dispensing device which is substantially compact so as to be conveniently disposed within a beverage vending machine.

A further object of the present invention is to provide an automatic drinking straw dispensing device which dispenses the drinking straws in a generally longitudinal orientation thereby minimizing an overall depth thereof and facilitating convenient positioning within a vending machine.

A further object of the present invention is to provide an automatic drinking straw dispensing device which only dispenses drinking straws when actually needed and to bona fide customers of a dispensing means with which the device is associated.

An additional object of the present invention is to provide an automatic drinking straw dispensing device structured to substantially prevent tampering with a drinking straw disposed in a dispensed orientation.

Also an object of the present invention is to provide an automatic drinking dispensing device which limits the number of straws to be retrieved by each user.

Another object of the present invention is to provide an automatic drinking straw dispensing device which is also capable of dispensing stirrers for use with a coffee or tea dispensing machine.

Yet another object of the present invention is to provide an automatic drinking straw dispensing device which is capable of dispensing rolled napkin assemblies and a variety of other articles disposed in a generally rolled or cylindrical orientation and/or configuration conveniently and effectively.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention is directed towards an automatic drinking straw dispensing device, generally indicated as 10. Although the automatic drinking straw dispensing device 10 of the present invention may be an independent, free standing unit, in the preferred embodiment it will preferably be mounted as part of an automatic dispensing machine 85, which is structured to dispense a beverage with which the drinking straw is to be utilized. As such, the automatic drinking straw dispensing device 10 of the present invention may be connected with the controls of the vending machine 85 for various features thereof.

In particular, the automatic drinking straw dispensing device 10 of the present invention includes a primary receptacle 20. The primary receptacle 20 defines a large open interior compartment 25 and is therefore structured to contain a plurality of drinking straws A therein, in a ready to be dispensed orientation. The drinking straws themselves, may be contained unwrapped or wrapped, so long as in either configuration they are able to roll or slide down a sloped surface. Further, the primary receptacle 20 preferably includes a generally elongate configuration so as to accommodate a length of the drinking straws, however is also generally shallow from a front surface to a rear surface such that it will not take up substantial amounts of space into the vending machine 85 wherein it is mounted.

Figure 1:
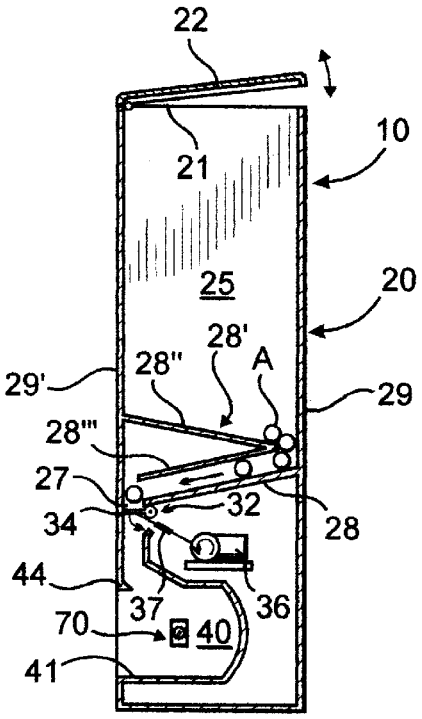
FIG. 1 is a side, cross-section view of a first preferred embodiment of the automatic drinking straw dispensing device of the present invention.
Figure 3:
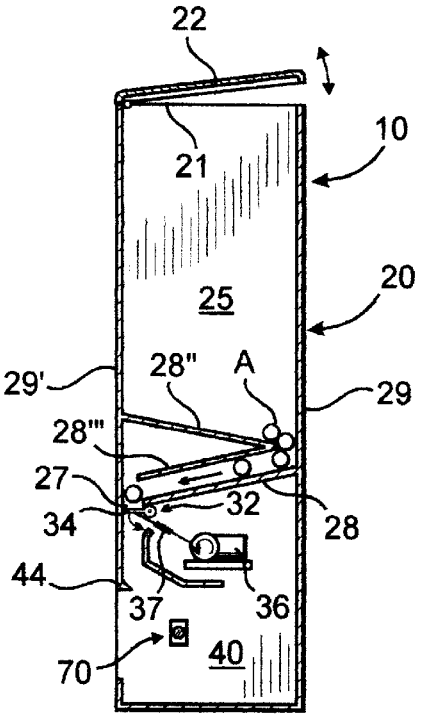
FIG. 3 is a side, cross-section view of a yet another embodiment of the automatic drinking straw dispensing device of the present invention.
Figure 4:
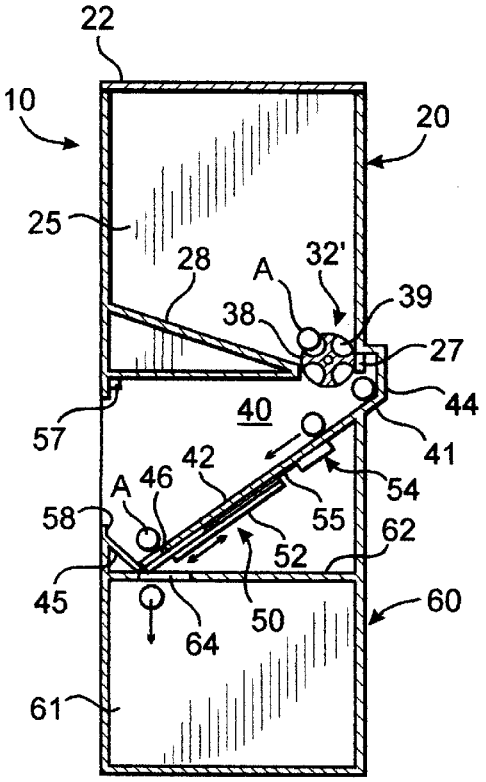
FIG. 4 is a side, cross-section view of a still another embodiment of the automatic drinking straw dispensing device of the present invention.
Figure 5:
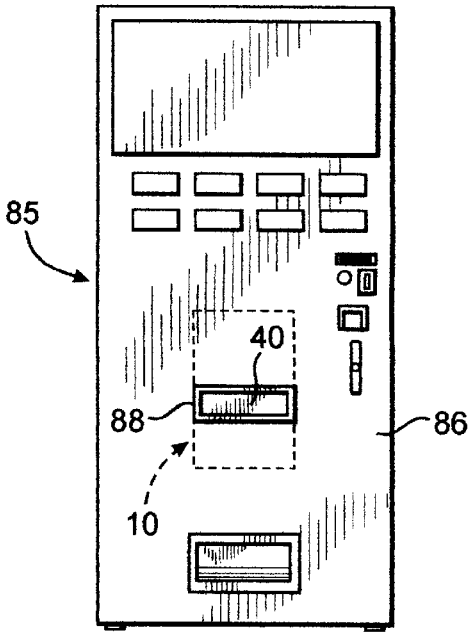
FIG. 5 is a front view of a vending machine including the automatic drinking straw dispensing device of the present invention mounted therein.

So as to provide access to the open interior compartment 25 of the primary receptacle 20, the primary receptacle 20 preferably includes an open top surface 21 structured to permit reloading of drinking straws therethrough into the open interior compartment 25 of the primary receptacle 20. Although the open top surface 21 may be completely and permanently opened, in an alternative embodiment, as illustrated in FIGS. 1 and 4 a hinged or otherwise openable cover 22 may be disposed in covering relation atop the open top surface 21, thereby maintaining an enclosed, cleaner environment within the open interior compartment 25. Also, as illustrated in FIG. 3, a generally smaller reloading opening 23 be may defined in a top surface of the primary receptacle 20 to permit access to the interior compartment 25 when reloading straws.

As illustrated in the Figures, the primary receptacle 20 preferably includes a generally slopped bottom surface 28. This slopped bottom surface 28, is preferably the actual bottom surface of the primary receptacle 20, however, it may merely be a ramped segment secured within the interior compartment 25 of the primary receptacle 20. Nevertheless, the slopped bottom surface 28 of the open interior compartment 25 is defined. The slopped bottom surface 28 is structured and disposed within the primary receptacle 20 so as to lead and/or guide drinking straws thereon towards a generally elongate slot 27 defined at or near a bottom of the slopped bottom surface 28 and preferably between the sloped bottom surface 28 and a face 29 or 29' of the primary receptacle 20. Specifically, the elongate slot 27 is structured and disposed to permit the selective passage of preferably only one drinking straw A therethrough when dispensing of one of the drinking straws is necessary.

Figure 2:
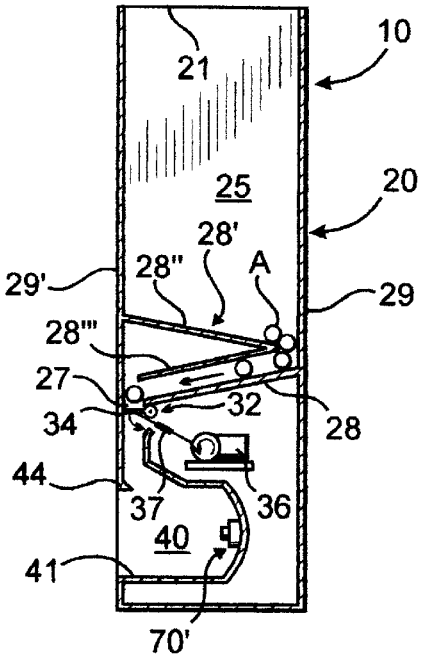
FIG. 2 is a side, cross-section view of another embodiment of the automatic drinking straw dispensing device of the present invention.

In order to ensure that only one of the drinking straws A is permitted to exit the primary receptacle 20 through the elongate slot 27 at one time, the present invention further includes a single straw dispensing assembly 32. The single straw dispensing assembly 32 is disposed in at least partially covering relation over the elongate slot 27 such that unless actuated from a normally closed position to an open position, a drinking straw A contained within the primary receptacle 20 will not be able to pass through the elongate slot 27. In a first preferred embodiment, as illustrated in FIGS. 1, 2 and 3, the single straw dispensing assembly 32 includes a dispensing stopper 34. In particular, the dispensing stopper 34 is preferably at least one plate or panel positioned to block off at least part of the elongate slot 27 so that a drinking straw A cannot pass therethrough. Furthermore, the dispensing stopper 34 is structured to move between an open and a closed position, wherein the closed position is structured to resist the movement of the drinking straw A through the elongate slot 27, and the open orientation permits free movement of the drinking straw A through the elongate slot 27. In the preferred embodiment, the dispensing stopper 34 is connected with a solenoid actuated lever or other actuation assembly 36 structured to open and close the dispensing stopper 34. In particular, the actuation assembly 36 is preferably connected to the dispensing stopper 34 by an elongate wire or biased spring 37 such that upon actuation the wire 37 pulls on the dispensing stopper 34, holding it in the open position long enough to permit a single drinking straw to be dispensed through the elongate slot 27. Subsequently, the actuation assembly 36 releases the dispensing stopper 34 such that it may return to its normal, closed orientation, such as by an internal biasing element. In this regard, it should be noted that a variety of sensors or like means could be incorporated to detect when a single drinking straw has been permitted to pass through the elongate slot 27 and cause the dispensing stopper 34 to return to its closed orientation; however, a timed opening and closing is generally sufficiently accurate.

Turning to FIG. 4, in an alternative embodiment the single straw dispensing assembly 32' includes at least one slotted drum 38. Specifically, the slotted drum 38, as with the dispensing stopper 34 may be a single elongate element extending across the entire length of the elongate slot 27, or may merely be one or more distinct elements disposed in a spaced relation from one another along a length of the elongate slot 27 so as to selectively prevent the drinking straw A from passing through the elongate slot 27. Looking specifically to the slotted drum 38, it is structured to include at least one slot 39 defined in a perimeter surface thereof. The slot 39 is structured to receive one of the drinking straws therein for subsequent dispensing. Specifically, as illustrated in FIG. 4, the slotted drum 38 may be disposed completely or partially within the primary receptacle 20, so as to receive a drinking straw A within one of the slots 39 and rotate that single straw until it is in communication with the elongate slot 27 and may essentially be dumped therethrough for subsequent dispensing. Of course, any actuation assembly sufficient to selectively rotate the slotted drum 38 a sufficient amount to expose only the next slot 39 at one time will be sufficient to ensure that only a single drinking straw is dispensed at one time.

Also in the preferred embodiments of FIGS. 1–3, a restrictor assembly 28' may also be disposed in the primary receptacle 20. The restrictor assembly 28' is structured to limit access by the drinking straws A into the elongate slot 27 so as to prevent overloading of the single straw dispensing assembly 32 or general clogging. For example, when the primary receptacle 20 is loaded with a plurality of drinking straws, the general configuration thereof will tend to urge all of the straws towards the elongate slot 27. Unfortunately, however,if too many drinking straws A are at the elongate slot 27 a blockage or an overload of the single straw dispensing assembly 32 so as to permit a premature, untriggered dispensing may occur. Accordingly, the restrictor assembly 28' preferably in the form of an angularly disposed panel 28' also disposed in the primary receptacle 20 is provided. The angularly disposed panel 28' is structured limit a number of the drinking straws A which can access the sloped bottom surface 28 of the primary receptacle 20 at one time, and which therefore can access the elongate slot 27. In the illustrated embodiment, it is preferred that a generally larger gap be provided such that one or more drinking straws A can drop down to the slopped bottom surface 28, but than only a single row of drinking straws A can access the elongate slot 27. In this regard a separate panel 28''' to prevent back up over the elongate slot 27 may be provided.

Figure 3A:
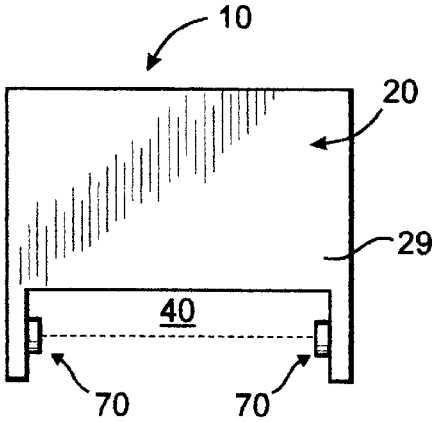
FIG. 3A is a front view of the embodiment of the automatic drinking straw dispensing device of FIG. 3.

Disposed in dispensing communication with the elongate slot 27 is a dispensing area 40. Specifically, the dispensing platform area 40 is disposed so that drinking straws which pass through the elongate slot 27 are naturally directed onto the dispensing area 40. In the preferred embodiment, disposed between the elongate slot 27 and the dispensing area 40 is a dispensing ramp 44. The dispensing ramp 44 is configured to ensure that a dispensed one of the drinking straws which passes through the elongate slot 27 is directed into a central region of the dispensing area 40. Moreover, the dispensing area 40 may be enclosed by a bottom surface 41 or, as illustrated in FIGS. 3 and 3A, may include an open bottom, depending upon the use. Furthermore, as in FIG. 4, a generally slopped bottom surface 41 may be provided such that the dispensed one of the drinking straws A will naturally slide or roll to a front end 42 of the dispensing area 40 where the dispensed straw A is maintained in an accessible, retrievable orientation. Furthermore, it is noted that the drinking straws are dispensed in a generally longitudinal position, thereby permitting a user to grasp or catch a central region of the drinking straw A, and further functioning to minimize an overall depth of the dispensing area 40 and a depth of the overall automatic drinking straw dispensing device 10 from its front surface 29' to its rear surface 29.

Looking further to the preferred embodiments of FIGS. 1–3, the present drinking straw dispensing assembly 10 also includes a switch assembly 70. The switch assembly 70 is cooperatively disposed with and preferably connected to the single straw dispensing assembly 32 so as to trigger the single straw dispensing assembly 32 into dispensing one of the drinking straws A through the elongate slot 27 upon actuation thereof. Although the switch assembly 70 may indeed be part of the normal controls of the beverage dispensing device 85 such that a drinking straw is dispensed upon dispensing of a beverage, in the preferred embodiments of the present invention a separate switch assembly 70. Specifically, the switch assembly is preferably communicably disposed with, and preferably within the dispensing area 40 such that upon introduction of a user's hand into the dispensing area 40, the switch assembly 70 is actuated. Moreover, the switch assembly 70 is preferably positioned within the dispensing area such that upon the user's hand entering the dispensing area 40 in a palm up orientation, a drinking straw A is dispensed and will drop directly into the user's hand. In this regard, the drinking straw may drop directly from the elongate slot 27, or the dispensing ramp 44 may direct the drinking straw A more directly into the user's hand. Although a variety of different switch assemblies 70 may be provided, the preferred embodiments include an optical or motion sensitive switch 70, such as an infra-red beam or proximity sensor, disposed in the dispensing area 40 and structured to detect passage of a user's hand into the dispensing area 40. Moreover, the switch assembly may include one or more of the switches 70 positioned in a horizontal, vertical or angled orientation, so long as entry into the dispensing area 40 is detected thereby. Also, in an alternative embodiment, as in FIG. 2, the switch assembly 70' may include a manually actuated switch 70', such as a button or switch, that can be actuated by a user upon their hand being within the dispensing area 40.

So as to prevent waste or tempering, the single straw dispensing assembly 32, such as through internal programming, a separate control, or programming of the switch assembly 70, is structured to dispense a drinking straw A only in conjunction with a beverage being dispensed by the beverage dispensing device 85. Of course, this function is preferably controlled by cooperative communication with the controls of the beverage dispensing device, which may also control at least this aspect of the present invention. Along the same lines, the single straw dispensing assembly 32 are structured to dispense only one, or a predetermined number of drinking straw A upon the dispensing of a beverage by the beverage dispensing device 85. As such, a user cannot retrieve multiple straws and deplete the supply un-necessarily. In the preferred embodiment, actuation of the switch assembly 70 can indicate that a drinking straw A has been dispensed and thereby shut down or over-ride further actuation of the switch. Of course, the previously recited control structures may also be incorporated for this feature as well. Furthermore, because it is understood that some users will not elect to take a drinking straw A, the preferred embodiment of the present invention is also structured such that the single straw dispensing assembly 32 can only dispense the drinking straw A for a predetermined period of time after the beverage has been dispensed by the beverage dispensing device 85. For example, a 30 second time delay circuit or switch may be provided such that the single straw dispensing assembly 32, either directly or by de-activation of the switch assembly 70, will not dispense a drinking straw A after the pre-set time period unless another beverage has been dispensed.

Looking in greater detail to the alternative embodiment of FIG. 4, the dispensing area 40 may include an upwardly ramped front lip 45 that functions to retain the dispensed drinking straw A at generally the front end 42 of the sloped bottom surface 41, and further prevents the drinking straw from merely rolling out of the dispensing area 40 as it is dispensed through the elongate slot 27. Also in this embodiment, a recycling assembly may be provided. It should be noted that various sensors and the like may also be incorporated in order to determine whether a drinking straw is present in the dispensing area 40 of this embodiment, and thereby halt dispensing of a subsequent straw; however, in the illustrated embodiment so as to maintain and maximize clean and sanitary conditions, the recycling assembly is included. In particular, the recycling assembly is structured and disposed to remove the dispensed one of the drinking straws A from the slopped bottom surface 41 if it is not retrieved. This will therefore prevent more than one drinking straw from backing up in the dispensing area 40 of this embodiment, and will ensure that a fresh one of the drinking straws is always available for retrieval each time a user seeks a straw. In this embodiment, the recycling assembly includes an elongate recycling slot 46 disposed generally at the front end 42 of the slopped bottom surface 41. Preferably, the dispensing slot 46 is disposed such that the dispensed one of the drinking straws A overlies the recycling slot 46 as it waits to be retrieved. Accordingly, disposed in covering relation to the elongate recycling slot 46 is a stopper element 50. Specifically, the stopper element 50 is structured to selectively prevent the dispensed one of the drinking straw A from passing through the elongate recycling slot 46, and as such is structured to move between an open orientation, wherein the drinking straw is permitted to pass through the elongate recycling slot 46, and a closed orientation, wherein the drinking straw is maintained in a ready to be retrieved orientation at the front end 42 of the slopped bottom surface 41. The stopper element 50 preferably includes at least one generally elongate plate which is structured to slide, preferably along an underside of the slopped bottom surface 41, and is retained in place by a mount bracket 52 or like element. The stopper element 50 is also connected to actuation means 54, such as through a wire or biased element 55, such that upon actuation the stopper element 50 will be pulled upwardly along the dispensing platform 40 to expose the elongate recycling slot 46. Conversely, after the dispensed drinking straw has been removed, the actuation means 54 will subsequently release the stopper element 50 and permit it to return to its blocking, closed orientation which prevents a subsequently dispensed drinking straw from automatically falling through the elongate recycling slot 46. In this embodiment the stopper element 50 is structured to move to its open orientation after a predetermined period of time. For example, the stopper element 50 may be structured to move to its opened orientation 45 seconds after the straw is initially dispensed into the dispensing area 40. Such timed recycling, therefore prevents that the drinking straw A will remain on the dispensing area 40 upon the subsequent dispensing of a new straw. Additionally, the stopper element 50 may also be configured so as to move to its opened orientation upon the dispensing of a subsequent beverage and therefore the actuation of the single straw dispensing assembly 32.

Further, because in an unattended dispensing situation there is always a risk that individuals may wish to tamper with the dispensed drinking straw A, and leave it in a dispensed orientation such that a subsequent, unsuspecting consumer will retrieve it prior to it being removed by the recycling means, the present invention further includes a tamper sensor 57 and 58. Specifically, the tamper sensor 57 and 58, which may include any conventional type of sensor device, such as a light beam or a plurality of light beams extending along an entire front edge of the dispensing area 40, are structured to detect passage of any object into the dispensing area 40 wherein the dispensed drinking straw A is located. In use, the tamper sensors 57 and 58 will be configured such that a predetermined period of time after an object is detected as passing thereby, the recycling assembly will automatically be actuated and any straw or article contained in the dispensing area 40 will be recycled. Naturally, such automatic recycling will provide sufficient time for an individual to retrieve the dispensed drinking straw, while ensuring that any object left behind is removed. Lastly in the embodiment of FIG. 4, and disposed so as to collect all drinking straws which are removed by the recycling assembly from the dispensing area 40, the recycling assembly further include a recycling bin 60. The recycling bin 60 includes a generally open interior compartment 61 wherein recycled drinking straws are contained until they may be removed to be discarded or otherwise reused. Further, while the recycling bin 60 may include a completely open upper surface, in the preferred embodiment it includes a generally elongate opening 64 defined in the top face 62 thereof and positioned in communication with the elongate recycling slot 46 such that any object passing therethrough passes into the opening 64 of the recycling bin 60.

Figure 6:
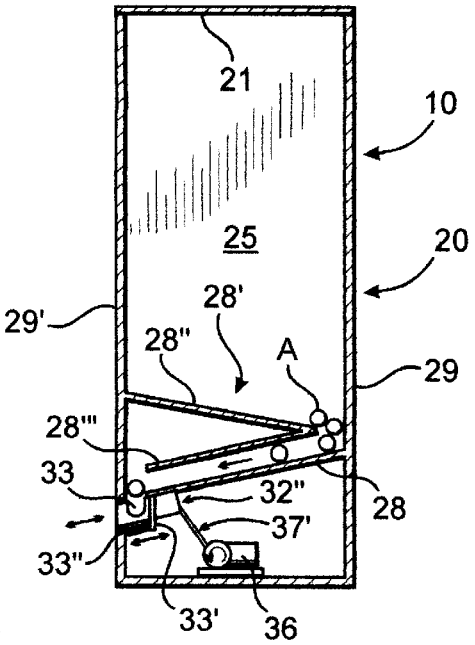
FIG. 6 is a side, cross-section view of yet another embodiment of the automatic drinking straw dispensing device of the present invention.
Figure 7:
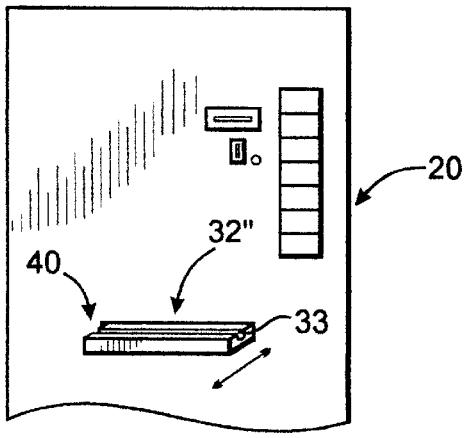
FIG. 7 is a partial front perspective view of the embodiment of FIG. 6.

Turning to yet another embodiment of FIGS. 6 and 7, the single straw dispensing assembly 32" may include a sliding platform having a recess 33 defined therein and into which a single straw may drop when the single straw dispensing assembly 32" is retracted into the primary receptacle 20. As such, in this embodiment, the dispensing area 40 is outside of the primary receptacle 20 when the single straw dispensing assembly 32" moves out a slot with a straw contained therein. Also in this embodiment, the actuation assembly 36 may include one or more wires or an actuation rod 37' to urge the single straw dispensing assembly 32" into a dispensing orientation, after which a biased element 33" pulls it back into a retracted position where a new straw may be loaded. This embodiment also preferably includes a stopper to limit outward movement of the single straw dispensing assembly 32", and if desired a timed retraction or a sensor may be disposed in the recess 33 to signal a retraction thereof. It is noted that such an embodiment may be particularly useful for other items such as cigars, cigarettes and the like as well as drinking straws.

It should be noted that the present invention can also be configured to be used with stirrers, such as in a coffee or tea vending machine. Additionally, for food vending situations or even for beverage vending situations a rolled napkin assembly may also be structured to be dispensed. In such a rolled napkin assembly, a napkin is bundled into a compact assembly, which may also include other utility items such as a toothpick or even a straw or stirrer, and is positioned with the primary receptacle 20 in the same fashion as a drinking straw. As such, the rolled napkin assembly will as be easily and conveniently dispensed in the same manner as the drinking straw will be dispensed. Moreover, cigarettes or cigars may also be dispensed in the present invention merely by adjusting the dimensions of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described.

What is claimed is:

1. An automatic drinking straw dispensing device comprising:

a primary receptacle, said primary receptacle being structured and disposed to contain a plurality of drinking straws therein, a generally elongate slot formed in said primary receptacle and structured to permit the passage of the drinking straws therethrough, a single straw dispensing assembly structured and disposed to selectively permit only one of the drinking straws to exit said primary receptacle through said elongate slot at one time, a dispensing area disposed generally beneath said generally elongate slot and structured to receive the dispensed drinking straw exiting said primary receptacle, and a switch assembly, said switch assembly being disposed so as to be actuated by a user's hand entering said dispensing area, and being structured to trigger said single straw dispensing assembly into dispensing one of the drinking straws through said elongate slot.

2. An automatic drinking straw dispensing device as recited in claim 1 wherein said switch assembly is cooperatively disposed relative to said dispensing area such that the dispensed drinking straw drops into the user's hand upon actuation of the switch assembly by the user's hand.

3. An automatic drinking straw dispensing device as recited in claim 2 wherein said switch assembly includes an optical switch structured to detect passage of the user's hand into said dispensing area.

4. An automatic drinking straw dispensing device as recited in claim 2 wherein said switch assembly includes a motion sensitive switch structured to detect passage of the user's hand into said dispensing area.

5. An automatic drinking straw dispensing device as recited in claim 2 wherein said switch assembly includes a mechanical switch disposed in said dispensing area.

6. An automatic drinking straw dispensing device as recited in claim 1 wherein said primary receptacle includes a sloped bottom surface structured and disposed to direct the drinking straws into said elongate slot.

7. An automatic drinking straw dispensing device as recited in claim 6 further including a restrictor assembly disposed in said primary receptacle and structured to limit access by the drinking straws to said elongate slot so as to prevent overloading of said single straw dispensing assembly.

8. An automatic drinking straw dispensing device as recited in claim 7 wherein said restrictor assembly includes an angularly disposed panel disposed in said primary receptacle and structured to limit a number of said drinking straws which access said sloped bottom surface of said primary receptacle at one time.

9. An automatic drinking straw dispensing device as recited in claim 1 wherein said single straw dispensing assembly includes a dispensing stopper structured to at least partially close said elongate slot until triggered by said switch assembly.

10. An automatic drinking straw dispensing device as recited in claim 9 wherein said dispensing stopper is normally biased in a closed position and said single straw dispensing assembly further includes a solenoid actuated lever structured to at least temporarily urge said dispensing stopper into an open position.

11. An automatic drinking straw dispensing device as recited in claim 1 wherein said primary receptacle is structured to be cooperatively disposed with a beverage dispensing device and said single straw dispensing assembly is structured to be triggerable only in conjunction with a beverage being dispensed by the beverage dispensing device.

12. An automatic drinking straw dispensing device as recited in claim 11 wherein said single straw dispensing assembly is structured to permit only one of the drinking straws to be dispensed for each beverage dispensed by the beverage dispensing device.

13. An automatic drinking straw dispensing device as recited in claim 12 wherein said single straw dispensing assembly is structured to be triggerable for only a pre-set period of time after the beverage is dispensed by the beverage dispensing assembly.

14. An automatic drinking straw dispensing device as recited in claim 11 wherein said single straw dispensing assembly is structured to be triggerable for only a pre-set period of time after the beverage is dispensed by the beverage dispensing assembly.

15. An automatic drinking straw dispensing device as recited in claim 1 further structured to dispense a stirrer.

16. An automatic drinking straw dispensing device as recited in claim 1 further structured to dispense a rolled napkin assembly.

17. An automatic drinking straw dispensing device as recited in claim 1 further structured to dispense a smoker's article.

18. An automatic drinking straw dispensing device as recited in claim 1 wherein said elongate slot is longitudinally disposed and said primary receptacle is generally narrow.

19. An automatic drinking straw dispensing device comprising:

a primary receptacle, said primary receptacle being structured and disposed to contain a plurality of drinking straws therein, a generally elongate slot formed in said primary receptacle and structured to permit the passage of the drinking straws therethrough, a single straw dispensing assembly structured and disposed to selectively permit only one of the drinking straws to exit said primary receptacle through said elongate slot at one time, a dispensing area disposed generally beneath said generally elongate slot and structured to receive the dispensed drinking straw exiting said primary receptacle, and a switch assembly, said switch assembly being cooperatively disposed with said dispensing area so as to be actuated by a user's hand entering said dispensing area, and being structured to trigger said single straw dispensing assembly into dispensing one of the drinking straws through said elongate slot, said switch assembly being further disposed such that the dispensed drinking straw drops into the user's hand upon actuation of the switch assembly by the user's hand, said primary receptacle being structured to be cooperatively disposed with a beverage dispensing device, and said single straw dispensing assembly being structured to be triggerable only in conjunction with a beverage being dispensed by the beverage dispensing device.

20. An automatic drinking straw dispensing device as recited in claim 19 wherein said single straw dispensing assembly is structured to permit only one of the drinking straws to be dispensed for each beverage dispensed by the beverage dispensing device.

21. An automatic drinking straw dispensing device as recited in claim 19 wherein said single straw dispensing assembly is structured to be triggerable for only a pre-set period of time after the beverage is dispensed by the beverage dispensing assembly.

* * * * *